US006691476B1

(12) United States Patent
Kunz

(10) Patent No.: US 6,691,476 B1
(45) Date of Patent: Feb. 17, 2004

(54) PLASTIC CORNER BEAD AND TRIM AND METHOD OF MANUFACTURE

(75) Inventor: Roland Kunz, Omaha, NE (US)

(73) Assignee: Phillips Manufacturing Co., Omaha, NE (US)

( * ) Notice: Subject to any disclaimer, the term of this patent is extended or adjusted under 35 U.S.C. 154(b) by 0 days.

(21) Appl. No.: 10/131,280

(22) Filed: Apr. 24, 2002

Related U.S. Application Data

(60) Provisional application No. 60/349,889, filed on Jan. 7, 2002.

(51) Int. Cl.[7] ..... E04B 2/00
(52) U.S. Cl. ..... 52/287.1; 52/255
(58) Field of Search ..... 52/255, 256, 287.1, 52/288.1

(56) References Cited

U.S. PATENT DOCUMENTS

| | | | | | |
|---|---|---|---|---|---|
| 2,796,641 | A | * | 6/1957 | Wollaeger | 52/255 |
| 3,255,561 | A | * | 6/1966 | Cable | 52/255 |
| 3,391,509 | A | * | 7/1968 | Fruman | 52/367 |
| 4,876,837 | A | * | 10/1989 | Kelly et al. | 52/287.1 |
| 4,982,540 | A | * | 1/1991 | Thompson | 52/288.1 |
| 5,752,353 | A | * | 5/1998 | Koenig et al. | 52/255 |
| 6,360,503 | B1 | * | 3/2002 | Koenig, Jr. | 52/287.1 |
| 6,447,872 | B1 | * | 9/2002 | Larson | 428/77 |
| 2002/0005023 | | * | 1/2002 | Ford | 52/214 |
| 2003/0033770 | | * | 2/2003 | Harel | 52/287.1 |

* cited by examiner

*Primary Examiner*—Brian E. Glessner

(57) ABSTRACT

A corner bead includes an elongated strip of plastic material with a central arcuate nose and a pair of flanges extending outwardly from the nose. The outward faces of the flanges have knurling formed thereon, to retain joint compound in place during dressing of the corner. In the preferred form of the invention, the knurling is in the form of diamond-shaped depressions formed uniformly across the length and width of the flange outward faces. The method of forming the knurled surface in the bead includes the step of forming separate depressions in an outer face of a flange of the bead immediately after the extrusion process, prior to the material cooling.

6 Claims, 2 Drawing Sheets

PLASTIC CORNER BEAD AND TRIM AND METHOD OF MANUFACTURE

CROSS-REFERENCES TO RELATED APPLICATIONS

Priority is claimed based upon Provisional Application Serial No. 60/349,889, entitled "Plastic Corner Bear and Trim for Drywall Construction", filed Jan. 17, 2002.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to drywall construction, and more particularly to improved corner bead and trim products formed of vinyl with knurling on exterior faces of the legs and a method of manufacturing the products.

(2) Background Information

Current building construction utilizes sheets of drywall, commonly referred to as "wallboard," to form the surfaces of interior walls of buildings. Drywall is typically formed of sheets of plaster sheathed in an outer wrapping of heavy construction paper.

In drywall construction, joints between adjacent sheets of drywall are usually covered by a paper tape extending lengthwise along the joint. To finish exterior corners in wallboard construction, metal corner beads and bullnose beads are typically installed. Similarly, metal trim is used to protect and finish a wallboard edge at window and door jams, while expansion joints are inserted between sheets of wallboard at predetermined intervals within buildings.

The above-described corner bead and trim products include metal flanges projecting outwardly, which are perforated with circular holes or elongated slots, so that the trim product may be fastened to the drywall panels using nails or the like. Wet plaster is then smoothed into place to cover the metal flanges, and edges of the plaster are smoothed and feathered to cover and conceal the metal edges.

Corner bead and other drywall trim products of the prior art have also been extruded from plastic. However, these plastic bead and trim products suffer several drawbacks. First, it is very difficult to adhere plaster to the plastic material of the bead and trim products. For this reason, prior art configurations of plastic trim products utilize grooves or perforations through the legs of the trim products to assist in retaining or "gripping" plaster.

However, both variations of these "gripping" configurations have problems. The grooved plastic extrusions utilize grooves that extend lengthwise along the length of the bead or trim product, so that they may be formed during the extrusion of the product. This forms grooves that are oriented vertically when the product is applied to drywall. Vertically oriented grooves are a problem because gravity will cause the wet plaster material to slide downwardly along the grooves, rather than being supported in position.

While the configuration of bead and trim products with perforations does a better job of holding plaster material when oriented vertically, such perforations also permit the plaster to pass completely through the flanges and then mushroom out under the flanges. This mushrooming of the plaster behind the flanges pushes the flanges outwardly away from the drywall, forming an unsightly slightly rolling surface. In addition, the use of perforations requires additional plaster or "mud," in order to fill the cavities formed by the perforations.

Finally, plastic trim products with apertures or perforations will typically require two coats of plaster to completely finish a joint. The first coat may cause "rolling" in those locations where the flange is pushed slightly away from the drywall, which must be leveled out with a subsequent coat of plaster. In the alternative, once the mud dries, the mud within the perforations in the flange will settle out, leaving concave dimples in the surface, which must be filled and smoothed with a second coat of mud.

BRIEF SUMMARY OF THE INVENTION

It is therefore a general object of the present invention to provide an improved vinyl corner bead that will retain joint compound in position on the bead legs when the products are oriented vertically.

Another object of the present invention is to provide an improved corner bead that requires less joint compound during finishing than prior art corner bead with perforated legs.

These and other objects will be apparent to those skilled in the art.

The corner bead of the present invention includes an elongated strip of plastic material with a central arcuate nose and a pair of flanges extending outwardly from the nose. The outward faces of the flanges have knurling formed thereon, to retain joint compound in place during dressing of the corner. In the preferred form of the invention, the knurling is in the form of diamond-shaped depressions formed uniformly across the length and width of the flange outward faces.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 2:
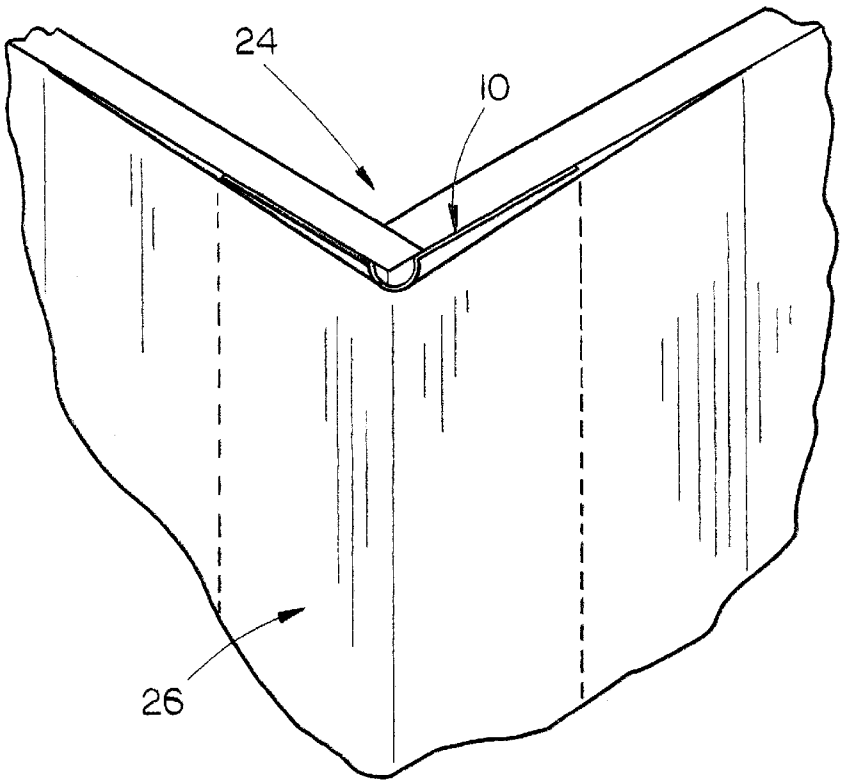
FIG. 2 is a view similar to FIG. 1, but with joint compound applied to the corner.
Figure 1:
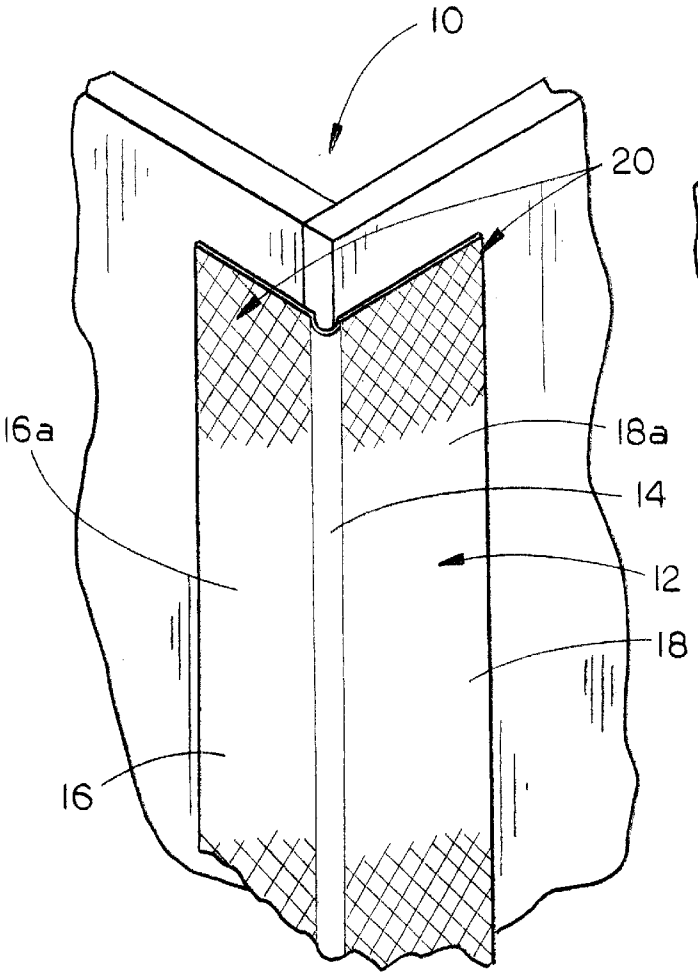
FIG. 1 is a perspective view of a corner bead of the present invention.

Referring now to the drawings, in which similar or corresponding parts are identified with the same reference numeral, and more particularly to FIG. 1, the plastic corner bead of the present invention is designated generally at 10, and is formed from an elongated extruded plastic strip 12. Strip 12 includes a central arcuate longitudinal channel forming a nose 14, with flanges 16 and 18 extending outwardly from each edge of the channel of nose 14. The nose 14 has an outside radius of up to about 1.5 inches, and projects outwardly from the plane of the outward faces of flanges 16 and 18 approximately 0.033 inches to provide space to receive joint cement or "mud" to thereby "dress" the corner, as shown in FIG. 2. Each flange 16 and 18 has a thickness of about 0.045 inches.

Figure 3:
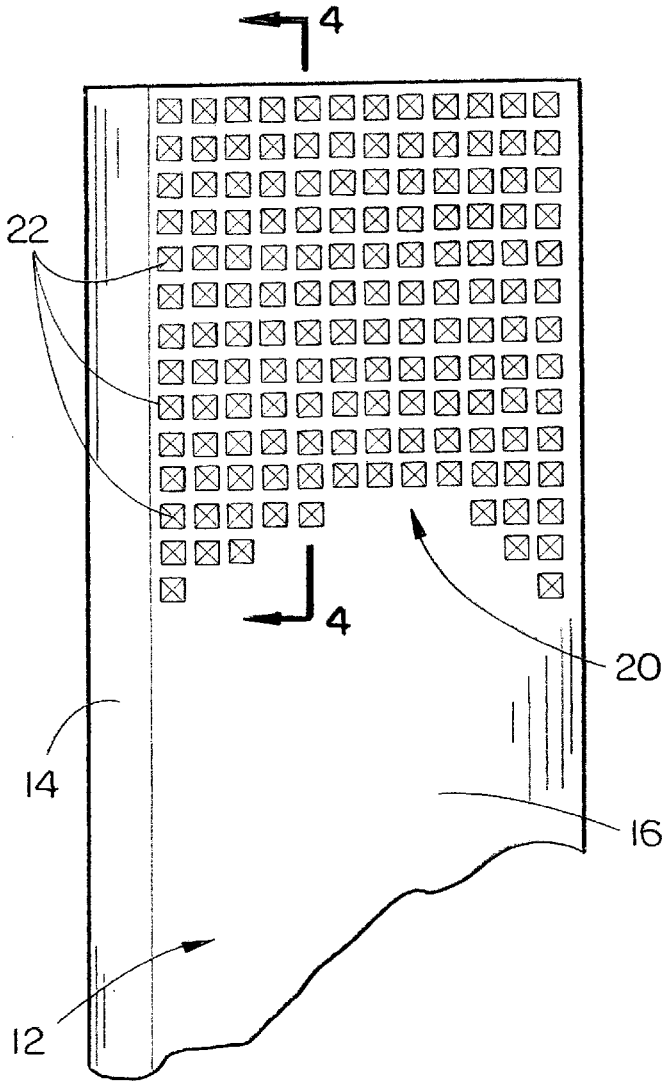
FIG. 3 is an elevational view of one leg of the corner bead of the invention, showing the knurling in more detail.
Figure 4:
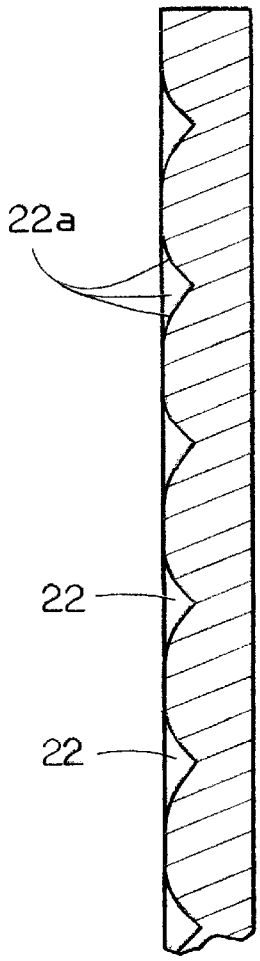
FIG. 4 is a cross-sectional view taken at lines 4—4 in FIG. 3.

The outward face 16*a* and 18*a* of each flange 16 and 18 has a knurled surface designated generally at 20. In the preferred form of the invention, knurled surfaces 20 are formed with a plurality of uniformly spaced, generally diamond-shaped shallow depressions or dimples 22, as shown in more detail in FIGS. 3 and 4. While the shape of the depressions is not critical, the use of depressions that do not extend completely through the thickness of the flanges, rather than perforations through the flanges, reduces the amount of mud required to dress the corner.

As noted above, prior art corner bead with vertical grooves will permit mud to flow down the bead when attempting to dress the corner. The use of dimples 22 having complete perimeter sidewalls 22*a*, prevents the mud from sliding vertically because of gravity. Dimples 22 preferably are spaced uniformly in rows and columns approximately 0.100 inches on center with the width/diameter of each dimple about 0.050 inches and the depth between 0.005 and 0.010 inches. In the preferred embodiment, with diamond-shaped dimples, four triangular-shaped sidewalls 22*a* form the dimples. Obviously, these sidewalls could be arcuate, cylindrical or spherical in shape as well.

In the method of manufacturing the corner bead 10, the bead is heated and extruded to form the overall shape of the corner bead 10. Immediately after formation in the die, the dimples are preferably formed while the plastic is still warm after the extruding process. In the preferred embodiment of the invention, this is accomplished by a roller die with diamond-shaped nubs projecting from the outside surface.

FIG. 2 shows the corner bead 10 installed on a wallboard corner joint 24, with mud 26 covering the bead 10 to dress the corner. While the preferred embodiment shows a corner bead, the same knurling 20 could be used on other related plastic or vinyl trim products, including, but not limited to bullnose, trim pieces, expansion control joints, etc.

Whereas the invention has been shown and described in connection with the preferred embodiments thereof, many modifications, substitutions and additions may be made which are within the intended broad scope of the appended claims.

What is claimed is:

1. A corner bead comprising:

an elongated strip of extruded plastic material, having a longitudinal arcuate channel forming a nose, and a pair of flanges extending outwardly from each side of the nose;

each flange having an outward face and a flat, smooth inward face; and a plurality of separate, independent spaced-apart depressions formed in the outward face of each flange, the depressions extending to a depth less than the thickness of the flange.

2. The corner bead of claim 1, wherein said extruded material is vinyl.

3. The corner bead of claim 1, wherein said depressions are spaced uniformly across the entire extent of each flange outward face.

4. The corner bead of claim 1, wherein said depressions extend to a depth of less than one-fourth the thickness of the flange.

5. The corner bead of claim 1, wherein each said depression has a shape with a continuous sloped perimeter sidewall.

6. The corner bead of claims 5, wherein each said depression is generally diamond-shaped, with four side surfaces sloping inwardly to a central well.

* * * * *